US005931132A

United States Patent [19]

Freeland

[11] Patent Number: 5,931,132

[45] Date of Patent: Aug. 3, 1999

[54] HYDRAULIC LASH ADJUSTER WITH PRESSURE RELIEF CHECK VALVE

[76] Inventor: Mark Freeland, 31037 Pine Cone Dr., Farmington Hills, Mich. 48331

[21] Appl. No.: 09/138,742

[22] Filed: Aug. 24, 1998

[51] Int. Cl.[6] ..... F01L 1/16; F01L 1/24

[52] U.S. Cl. ..... 123/90.43; 123/90.46; 123/90.55; 123/90.57; 123/90.19

[58] Field of Search ..... 123/90.19, 90.43, 123/90.46, 90.55, 90.57

[56] References Cited

U.S. PATENT DOCUMENTS

| | | | |
|---|---|---|---|
| 3,273,548 | 9/1966 | Hoffman . | |
| 3,587,539 | 6/1971 | Dadd . | |
| 3,799,129 | 3/1974 | Cornell . | |
| 3,805,753 | 4/1974 | Bergmann . | |
| 4,004,558 | 1/1977 | Scheibe . | |
| 4,098,240 | 7/1978 | Abell . | |
| 4,438,739 | 3/1984 | Arai . | |
| 4,462,364 | 7/1984 | Kodama . | |
| 4,481,913 | 11/1984 | Wirth . | |
| 4,546,734 | 10/1985 | Kodama | 123/90.43 |
| 4,589,383 | 5/1986 | Showalter . | |
| 4,596,213 | 6/1986 | Hillebrand . | |
| 4,633,827 | 1/1987 | Buente . | |
| 4,807,576 | 2/1989 | Sonoda . | |
| 4,840,153 | 6/1989 | Aida . | |
| 4,941,438 | 7/1990 | Muto | 123/90.43 |
| 4,977,867 | 12/1990 | Rhoads | 123/90.57 |
| 5,398,648 | 3/1995 | Spath . | |
| 5,622,147 | 4/1997 | Edelmayer . | |
| 5,623,898 | 4/1997 | Bruton | 123/90.57 |
| 5,660,153 | 8/1997 | Hampton . | |

*Primary Examiner*—Weilun Lo

[57] ABSTRACT

A hydraulic lash adjuster mechanism for an internal combustion engine, the adjuster having a body with a bore formed therein, a plunger slidingly received within the bore, and a high pressure chamber formed between the bottom of the bore and the plunger. The plunger has a fluid chamber formed therein to receive engine fluid through an inlet opening and is in communication with a first check valve mechanism for regulating the flow of fluid from the fluid chamber through a valve opening into a high pressure chamber. A leak path allows fluid to escape from the high pressure chamber due to increased force on the plunger. The high pressure chamber is in communication with a second check valve mechanism for allowing fluid to leak from the high pressure chamber at an increased rate in response to increased force on the plunger.

20 Claims, 2 Drawing Sheets

HYDRAULIC LASH ADJUSTER WITH PRESSURE RELIEF CHECK VALVE

TECHNICAL FIELD

The present invention relates generally to hydraulic lash adjusters. More specifically, the present invention relates to a hydraulic lash adjuster for an internal combustion engine which incorporates a second check valve to provide a faster leak down of engine fluid when the engine exhaust valve is subjected to high forces.

BACKGROUND

Hydraulic lash adjusters for internal combustion engines have been in use for many years. Hydraulic lash adjusters are used to eliminate clearance or lash between engine valve train components which occur under varying operating conditions, in order to maintain engine efficiency and to reduce noise and wear in the valve train.

Hydraulic lash adjusters operate by transmitting the energy of the valve actuating cam through hydraulic fluid trapped in a pressure chamber beneath a plunger. During each operation of the cam, as the length of the valve actuating components vary due to temperature changes, small quantities of hydraulic fluid are permitted to enter or escape from the pressure chamber. As the hydraulic fluid enters or escapes the pressure chamber, the position of the plunger is adjusted and consequently the effective total length of the valve train is adjusted which minimizes or eliminates the lash.

In current hydraulic lash adjusters, the escape of hydraulic fluid from the pressure chamber is most commonly accomplished by a leak path located between the plunger and the wall of the lash adjuster body member. Such escape or "leakdown" through these leak paths is controlled solely by the fit of the plunger within the body. The manufacture of these leak paths requires close manufacturing tolerances between the plunger and the body member, which is typically an expensive operation. Such prior art lash adjusters are disclosed, for example, in U.S. Pat. Nos. 4,438,739, 4,481,913, 4,462,364, 4,633,827, and 4,840,153.

Another system for minimizing lash is shown in U.S. Pat. No. 5,622,147. This configuration eliminates leak paths between the plunger and the cylinder and instead uses a normally open ball check valve, with limited travel, in place of a normally closed ball check valve.

None of these prior lash adjusting systems adequately compensate for the rapid growth of the exhaust valve stem which can occur immediately after a cold start and can cause damage to the valve or valve seat. This is partly because while hydraulic lash adjusters can increase their length quickly, they require more time to contract. The shrink rate of the lash adjuster is a function of the oil viscosity and temperature. When the oil is cold, the shrink rate is slow because the leak path between the plunger and the lash adjuster body remains constant.

From a cold start, current lash adjusters have difficulty compensating for the initial valve growth rate during approximately the first 2,000 engine cycles. This can result in operation problems. Increase growth can result in the exhaust valve hanging open, which in turn can result in the exhaust valve becoming even hotter and growing even more. This can further result in loss of power output and deposit buildup on the valve stem.

SUMMARY OF THE INVENTION

The present invention is directed to overcoming one or more of the problems as set forth above. It is an object of the present invention to provide a lash adjuster mechanism with increased leak down rate to compensate for any displacement of the valve from its valve seat during a combustion event, particularly at startup.

A further object of the present invention is to provide a lash adjuster that can compensate for increased force on the lash adjuster plunger by releasing oil from the lash adjuster high pressure chamber through a second check valve mechanism.

According to the present invention, the foregoing and other objects are attained by providing a hydraulic lash adjuster for an internal combustion engine, the lash adjuster including a body having a bore formed therein. A plunger is slidingly received within the bore of the lash adjuster body. The lash adjuster has a high pressure chamber formed between the bottom of the first bore and the plunger. The plunger has a fluid chamber formed therein which is in communication with an inlet opening for supplying engine fluid thereto. A first valve opening in the plunger provides fluid communication between the fluid chamber and the high pressure chamber. A first check valve element is positioned within the body to selectively open or close the first valve opening in response to any pressure difference between the fluid chamber and the high pressure chamber. A leak path between the lash adjuster body and the plunger allows fluid to leak from the high pressure chamber due to increased force on the plunger. A second valve opening is located in the bottom of the first bore and is in communication with a second check valve for allowing fluid to leak from the high pressure chamber at an increase rate in response to increased force on the plunger.

Additional objects and features of the present invention will become apparent upon review of the drawings and accompanying detailed description of the preferred embodiments.

DESCRIPTION OF THE PREFERRED EMBODIMENT

Figure 1:
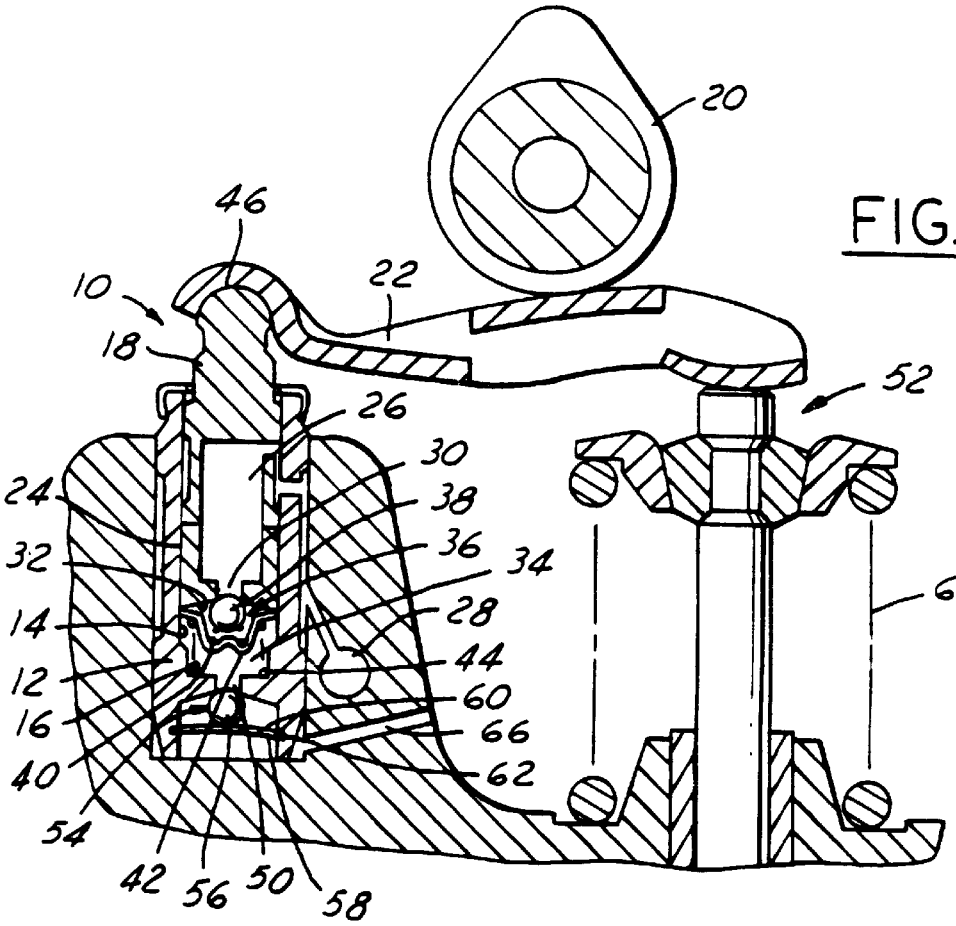
FIG. 1 is a cross-sectional illustration of a lash adjuster with a second check valve in a closed position with the engine valve closed in accordance with a preferred embodiment of the present invention.
Figure 2:
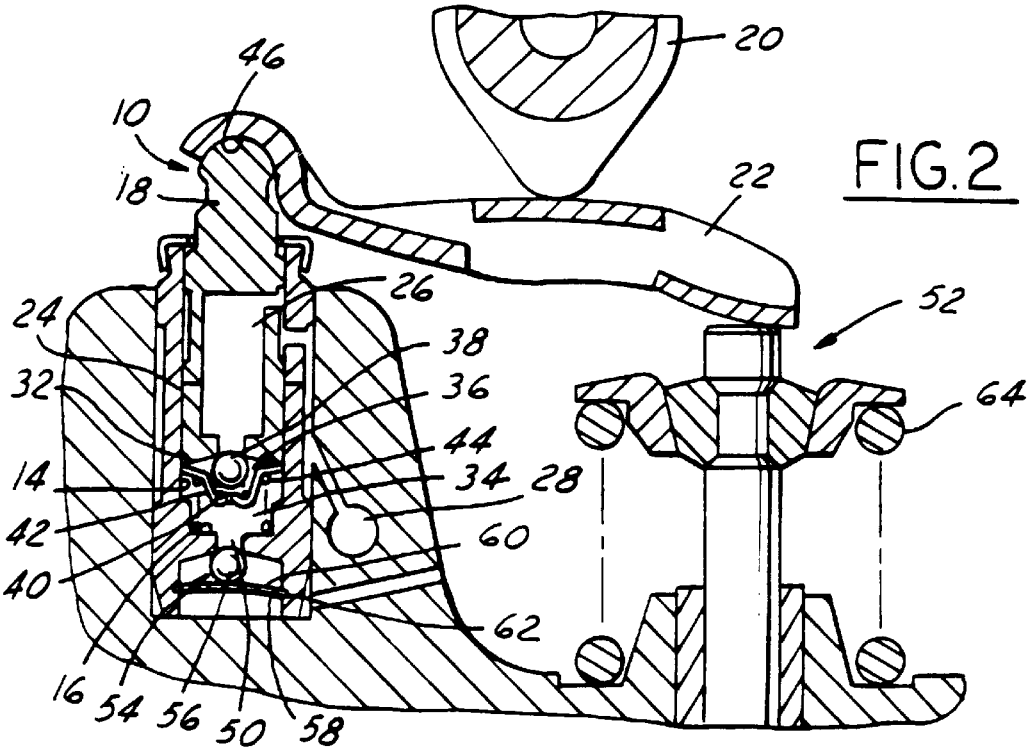
FIG. 2 is a cross-sectional illustration of a lash adjuster with a second check valve in a closed position with the engine valve open in accordance with a preferred embodiment of the present invention.
Figure 3:
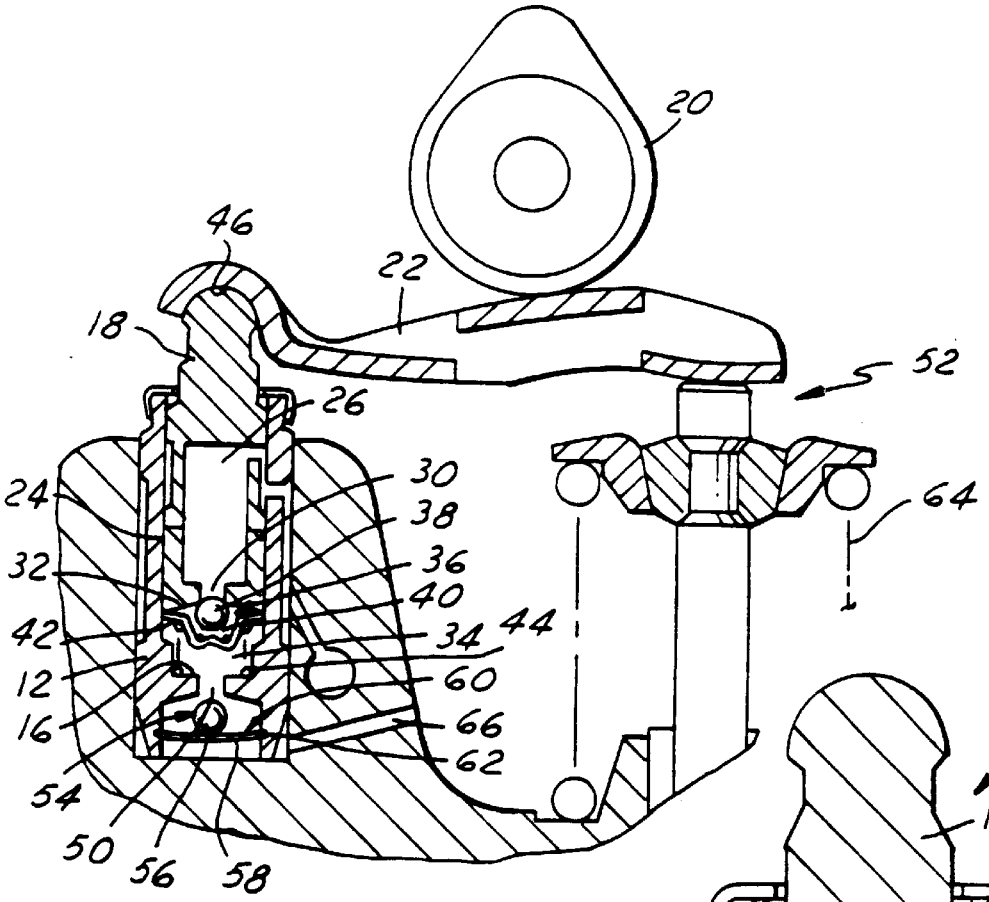
FIG. 3 is a cross-sectional illustration of a lash adjuster with a second check valve in an open position when the engine valve is almost closed in accordance with a preferred embodiment of the present invention.
Figure 4:
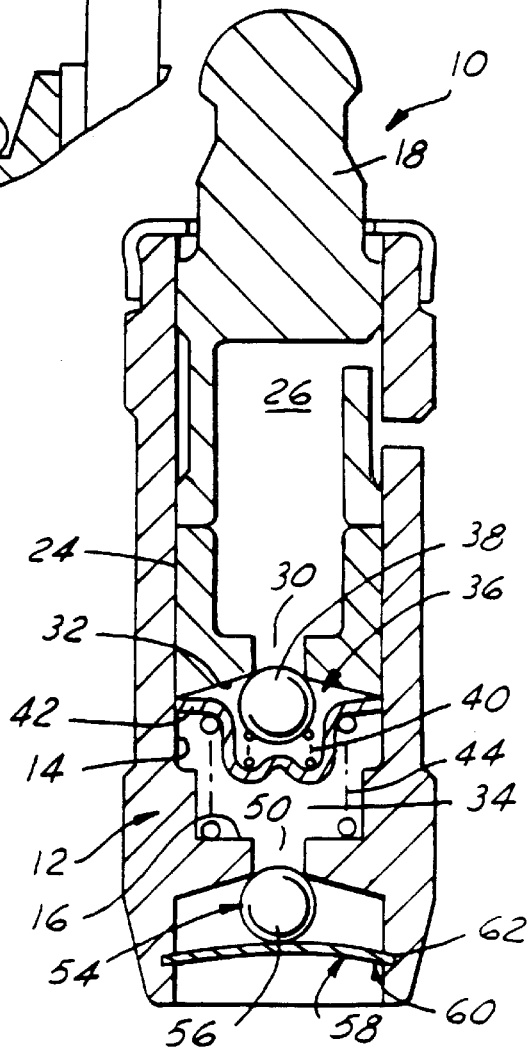
FIG. 4 is an enlarged cross-sectional illustration of a lash adjuster in accordance with a preferred embodiment of the present invention.

FIGS. 1 through 4 illustrate a preferred embodiment of a lash adjuster in accordance with the present invention. FIG. 1 illustrates the lash adjuster with the engine valve 52 closed while FIG. 2 illustrates the lash adjuster when the engine valve 52 is open. FIG. 3 illustrates the lash adjuster when the engine valve 52 is almost closed. FIG. 4 is an enlarged cross-sectional illustration of a lash adjuster.

With reference to FIGS. 1 through 4, the lash adjuster 10 includes a body member 12 in which a bore 14 is formed. The bottom of the bore 14 is defined by surface 16. A plunger 18 is telescopically positioned within the bore 14, such that the plunger 18 can move with respect to the body member 12. The plunger 18 is preferably in communication with a valve actuated cam 20 through a cam follower 22 which limits the motion of the plunger 18 away from surface 16.

The plunger 18 is machined such that a normal leak path 24 is formed between the outer diameter of the plunger 18 and the inner diameter of the bore 14. The plunger 18 has a fluid chamber 26 formed therein for receiving an engine fluid, such as oil or the like, through a fluid inlet passage 28. The fluid chamber 26 has a first valve opening 30 preferably formed through its bottom surface 32. The first valve opening 30 allows engine fluid from the fluid chamber 26 to flow to a high pressure chamber 34 defined by the area between the bottom surface 32 of the plunger 18, the bottom bore surface 16 and the inner diameter of the lash adjuster body 12.

The high pressure chamber 34 has a first check valve 36 which regulates the flow of engine fluid from the fluid chamber 26 through the first valve opening 30 and to the high pressure chamber 34. The first check valve 36 preferably includes a ball valve member 38 which has a diameter sufficient to seal off the first valve opening 30. The ball valve member 38 is preferably biased by a spring member 40 into a closed position wherein the first check valve 36 is closed and engine fluid is prevented from flowing out of the high pressure chamber 34. The spring member 40 is supported on a platform member 42 which is held in contact with the bottom surface 32 of the plunger 18 by spring member 44. Thus, the first check valve 36 will travel up and down as the plunger 18 is moved within the lash adjuster body 12 toward and away from the bottom bore surface 16. It should be understood that any other valve arrangement that allows for the selective engagement with the first valve opening 30 described above may instead be utilized in accordance with the present invention.

Plunger spring member 44 is positioned in the high pressure chamber 34 between the bottom bore surface 16 and the bottom surface 32 of the plunger 18. The plunger spring 44 biases the plunger 18 away from surface 16 causing the plunger 18 to move when there is no force on its top portion 46 thus eliminating any lash in the valve or valve train components.

The high pressure chamber 34 includes a second valve opening 50 for relieving pressure in the high pressure chamber 34 when it exceeds a certain level. Since leak path 24 has a limited size, it can only accommodate the leak down of a limited rate of engine oil, which is often not sufficient to compensate for the growth rate of the engine valve 52 during engine warm up after a cold start. The second valve opening 50 allows the leak down rate of engine fluid to be increased when the engine valve 52 is not properly closed during a combustion event.

A second check valve 54 is in communication with the second valve opening 50. The second check valve 54 preferably includes a ball member 56 with a diameter large enough to seal off the second valve opening 50. The ball member 56 is biased into a closed position (FIGS. 1 and 2) preventing engine fluid from flowing through the second valve opening 50 by a leaf spring 58 or the like. The leaf spring 58 is preferably retained about its periphery 60 in a groove 62 formed in the inner diameter of the lash adjuster body 12.

In operation, the plunger 18 is moved within the lash adjuster body 12 by the spring 44 to extend the plunger 18 and by the valve spring 64 and by combustion forces acting on the engine valve 52 to retract the plunger 18. The cam operating cycle comprises two distinct events: a base circle event and a valve actuation event. The base circle event is characterized by a constant radius between the cam center of rotation and the cam follower 22 during which effectively no cam energy is transmitted. The valve actuation event is characterized by a varying radius between the cam center of rotation and the cam follower 22 which effectively transmits cam energy to open and close the engine valve 52.

During the valve actuation event, a portion of the loads due to the valve spring, the inertia of the valve train components, and the cylinder pressure are transmitted through the valve train to the lash adjuster 10. The load acts on the plunger 18 and raises the pressure of the hydraulic fluid within the lash adjuster high pressure chamber 34 in proportion to the plunger area causing some fluid to escape through the normal leak path 24. As the fluid escapes, the plunger 18 moves down according to the change in volume of the high pressure chamber 34, shortening the effective length of the valve train.

During the base circle event (FIG. 1), the lash adjuster plunger spring 44 biases and moves the plunger 18 upwardly away from surface 16 such that no clearance or lash exists between the valve actuation components. Hydraulic fluid is drawn into the high pressure chamber 34 through the first check valve 36 in response to the increased volume of the high pressure chamber 34 as the plunger 18 moves up. If the effective length of the valve train shortens during the cam cycle, positive lash is created and the lash adjuster extends, moving the plunger 18 to a higher position at the end of the cycle than at the beginning. Inversely, as shown in FIG. 3, if the effective length of the valve train lengthens during the cam cycle, negative lash is created and the lash adjuster contracts, moving the plunger 18 to a lower position at the end of the cycle than at the beginning.

In the normal situation, when the pressure in the high pressure chamber 34 is increased, engine oil leaks down from the high pressure chamber 34 through the leak path 24 allowing any negative lash to be eliminated. However, if the initial valve growth rate at start up exceeds the growth rate of the cylinder head less the leak rate through the leak path 24, then the lash adjuster cannot accommodate for this increased negative lash which can result in the exhaust valve hanging open. This in turn can result in increased engine valve 52 growth causing power output loss and engine stall. This can also cause deposit buildup on the valve stem. Since the normal leak path 24 has a limited size, it cannot relieve engine fluid from the high pressure chamber 34 at a sufficient rate in order to eliminate negative lash after cold start up.

Accordingly, under these circumstances, the pressure in the high pressure chamber will exceed a predetermined level during each combustion event and the normally closed second check valve 54 is moved to an open position, as shown in FIG. 3. The second check valve 54 is moved against the force of the spring 58 allowing engine fluid to pass through the second valve opening 50 and into the engine sump (not shown). When the pressure in the high pressure chamber 34 has decreased and any negative lash due to the initial growth of the valve has been eliminated, the force of the spring 58 biases the ball member 56 back into engagement with the second valve opening 50 (FIGS. 1 and 2), thereby closing the second check valve 54. A passageway 66 is in communication with the second valve opening 50 allowing engine fluid that passes therethrough to exit the lash adjuster body 12 and drain to the engine sump.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed is:

1. A hydraulic lash adjuster for an internal combustion engine comprising:

a body having a bore formed therein said bore having a bottom;

a plunger slidingly received within said bore;

a high pressure chamber formed between a bottom of said bore and said plunger;

a fluid chamber within said plunger;

an inlet opening for supplying engine fluid to said fluid chamber;

a first valve opening in said plunger providing fluid communication between said fluid chamber and said high pressure chamber;

a first check valve mechanism for selectively opening or closing said first valve opening in response to pressure differences between said fluid chamber and said high pressure chamber;

a leak path allowing fluid to leak from said high pressure chamber due to increased force on said plunger;

a second valve opening located in said bottom of said bore; and a second check valve mechanism for allowing fluid to leak from said high pressure chamber in response to increased force on said plunger.

2. The lash adjuster of claim 1, wherein said inlet opening is formed through said body.

3. The lash adjuster of claim 1, further comprising a biasing spring located in said high pressure chamber to bias said plunger against forces applied to said plunger.

4. The lash adjuster of claim 1, wherein said first check valve mechanism includes a first ball valve.

5. The lash adjuster of claim 4, wherein said first check valve mechanism further includes a housing for said first ball valve and a spring member positioned between said housing and said first ball valve to support said first ball valve in a normally closed position.

6. The lash adjuster of claim 4 wherein said first check valve mechanism is biased into engagement with said first valve opening through the influence of gravity.

7. The lash adjuster of claim 1, wherein said second check valve mechanism includes a second ball valve.

8. The lash adjuster of claim 7, wherein said second ball valve is biased into a closed position by a leaf spring member.

9. The lash adjuster of claim 8, wherein when the pressure in said high pressure chamber reaches a predetermined threshold, the biasing force of the leaf spring member will be overcome and the ball valve will move away from said second valve opening allowing fluid to flow from said high pressure chamber to an engine oil sump.

10. A system for minimizing lash in an internal combustion engine having an engine valve comprising:

a lash adjuster assembly comprising:

a body having a closed bore formed therein, said bore having a bottom;

a plunger slidingly received within said bore periphery, said plunger having a top surface and a bottom surface;

a low pressure chamber formed within said assembly;

a high pressure chamber formed in said assembly between said bore bottom surface and said plunger;

a first valve opening formed in said assembly providing fluid communication between said low pressure chamber and said high pressure chamber;

a first check valve mechanism for selectively opening or closing said first valve opening;

a second valve opening formed in said assembly providing fluid communication between said high pressure chamber and an engine sump; and a second check valve mechanism for selectively allowing fluid to exit said high pressure chamber;

a cam for imparting force and motion to said assembly.

11. The system of claim 10, further comprising:

a leak path formed between said piston and said bore periphery allowing fluid to exit said high pressure chamber due to increased force on said plunger.

12. The system of claim 11, wherein said second check valve mechanism is contacting said second valve opening preventing fluid from exiting said high pressure chamber when said engine valve is closed.

13. The system of claim 12, wherein said second check valve mechanism is contacting said second valve opening preventing fluid from exiting said high pressure chamber when said engine valve is open.

14. The system of claim 13, wherein said second check valve mechanism allows fluid to exit said high pressure chamber through said second valve opening when said engine valve is almost closed.

15. The system of claim 14, wherein said second check valve mechanism includes a ball member normally biased into contact with said second valve opening by a leaf spring.

16. The system of claim 14, further comprising a spring member positioned within said high pressure chamber normally biasing said piston generally upward.

17. The system of claim 11, wherein said first check valve mechanism opens and closes said first valve opening in response to pressure differences between said fluid chamber and said high pressure chamber.

18. The system of claim 11, wherein said second check valve mechanism opens and closed said second valve opening in response to increased force on said plunger.

19. A lash adjuster assembly for an internal combustion engine, comprising:

a body having a bore formed therein, said bore having a bottom;

a plunger slidingly received within said bore;

a high pressure chamber formed between said bottom of said bore and said plunger;

a fluid chamber within said plunger;

an inlet opening for supplying fluid to said fluid chamber;

a first valve opening in said plunger providing fluid communication between said fluid chamber and said high pressure chamber;

a first check valve mechanism, including a ball member normally biased into contact with said first valve opening by a first spring member and a platform member for supporting said first spring member, for selectively opening or closing said first valve opening in response to pressure differences between said fluid chamber and said high pressure chamber;

a leak path allowing fluid to leak from said high pressure chamber due to increased force on said plunger;

a second valve opening located in the bottom of said bore; and a second check valve mechanism, including a ball member and a leaf spring normally biasing said ball into contact with said second valve opening, for allowing fluid to leak from said high pressure chamber in response to increased force on said plunger.

20. The assembly of claim 19, further comprising a biasing spring located in said high pressure chamber to bias said plunger against forces applied to said plunger.

* * * * *